US009435579B1

(12) United States Patent
House et al.

(10) Patent No.: US 9,435,579 B1
(45) Date of Patent: Sep. 6, 2016

(54) INSULATED DOOR ASSEMBLY

(71) Applicant: Electrolux Home Products, Inc., Charlotte, NC (US)

(72) Inventors: David House, Anderson, SC (US); Carlos Cordero, Anderson, SC (US); Chris A. Baker, Anderson, SC (US); Adam Ellis, Anderson, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 14/683,234

(22) Filed: Apr. 10, 2015

(51) Int. Cl.
*A47B 96/04* (2006.01)
*F25D 23/02* (2006.01)
*E05D 7/00* (2006.01)

(52) U.S. Cl.
CPC ..... *F25D 23/028* (2013.01); *E05D 7/00* (2013.01); *F25D 2201/12* (2013.01)

(58) Field of Classification Search
CPC ..... F25D 23/028
USPC ..... 312/405.1, 401, 405; 49/382, 385, 397, 49/398, 501
See application file for complete search history.

(56) References Cited

U.S. PATENT DOCUMENTS

| | | | | |
|---|---|---|---|---|
| 4,151,681 | A * | 5/1979 | Roberts | E05D 3/04 312/321.5 |
| 4,955,675 | A | 9/1990 | Donaghy | |
| 5,655,351 | A | 8/1997 | Pohl et al. | |
| 5,787,724 | A | 8/1998 | Pohl et al. | |
| 6,192,630 | B1 | 2/2001 | Banicevic | |
| 6,209,265 | B1 | 4/2001 | Banicevic | |
| 2010/0154462 | A1 | 6/2010 | Barandalla et al. | |
| 2010/0156260 | A1 | 6/2010 | Barandalla et al. | |
| 2010/0170290 | A1 | 7/2010 | Barandalla et al. | |
| 2014/0132144 | A1 | 5/2014 | Kim et al. | |

* cited by examiner

*Primary Examiner* — Matthew Ing
(74) *Attorney, Agent, or Firm* — Pearne & Gordon LLP

(57) ABSTRACT

A door for a refrigerator appliance is pivotally connected by a hinge. The door includes a polygonal shell having corners and defining at least part of a cavity therein and a hinge bearing mounted to the polygonal shell adjacent one of the corners. The hinge bearing extends into the cavity and defines a generally cylindrical passage to receive and journal a hinge pin of the refrigerator appliance. A reinforcement tube is secured to the hinge bearing and extends a distance within the cavity. The reinforcement tube includes a sidewall that defines a hollow interior, and at least one hole extends through the sidewall to provide communication between the cavity and the hollow interior. Insulation is foamed in place that substantially fills the cavity including the corner, and the insulation penetrates into the hollow interior of the reinforcement tube via the at least one hole.

18 Claims, 5 Drawing Sheets

INSULATED DOOR ASSEMBLY

CROSS-REFERENCE TO RELATED APPLICATIONS

Not applicable.

FIELD OF THE INVENTION

The present application relates generally to insulated panels, and more particularly, to an improved foamed-in-place, insulated panel assembly particularly suited for use as a door on an appliance, such as for refrigerators, freezers, and the like.

BACKGROUND OF THE INVENTION

Appliances such as refrigerators, freezers, and the like provide insulated doors mounted by a hinge structure on the main cabinet of the unit. Usually, such doors include a sheet metal shell providing the exterior surface and a molded plastic liner shaped to provide interior storage shelves and compartments. The cavity between the shell and the liner is usually filled with insulation, and in some cases is filled with a foamed-in-place foam insulation. The insulation extends along the entire door to thereby provide a full barrier to the transmission of heat so that the efficiency of the unit is increased and undesirable localized zones of condensation do not develop.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect, a door for a refrigerator appliance is pivotally connected by a hinge. The door comprises a polygonal shell having corners and defining at least part of a cavity therein and a hinge bearing mounted to the polygonal shell adjacent one of said corners. The hinge bearing extends into the cavity and defines a generally cylindrical passage to receive and journal a hinge pin of said refrigerator appliance. A reinforcement tube is secured to the hinge bearing and extends a distance within the cavity. The reinforcement tube comprises a sidewall that defines a hollow interior, and at least one hole extends through the sidewall to provide communication between the cavity and the hollow interior. Insulation is foamed in place that substantially fills said cavity including said corner, and the insulation penetrates into the hollow interior of the reinforcement tube via said at least one hole.

In accordance with another aspect, a door for a refrigerator appliance is pivotally connected by a hinge. The door comprises an exterior panel, an end panel connected to the exterior panel, and a corner being defined at an intersection of the exterior panel and end panel. An inner liner is connected to the exterior panel and spaced therefrom to define a cavity. A hinge bearing is mounted to the end panel adjacent said corner and defines a generally cylindrical passage to receive and journal a hinge pin of said refrigerator appliance. The cylindrical passage is open at an outer end exterior of the shell and substantially closed at an inner end. A reinforcement tube is secured to the inner end of the hinge bearing and extends a distance within the cavity. The reinforcement tube comprises a sidewall that defines a hollow interior and at least one hole extends through the sidewall to provide communication between the cavity and the hollow interior. Insulation is foamed in place filling said cavity including said corner, and the insulation penetrates into the hollow interior of the reinforcement tube via said at least one hole.

It is to be understood that both the foregoing general description and the following detailed description present example and explanatory embodiments of the invention, and are intended to provide an overview or framework for understanding the nature and character of the invention as it is claimed. The accompanying drawings are included to provide a further understanding of the invention and are incorporated into and constitute a part of this specification. The drawings illustrate various example embodiments of the invention, and together with the description, serve to explain the principles and operations of the invention.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
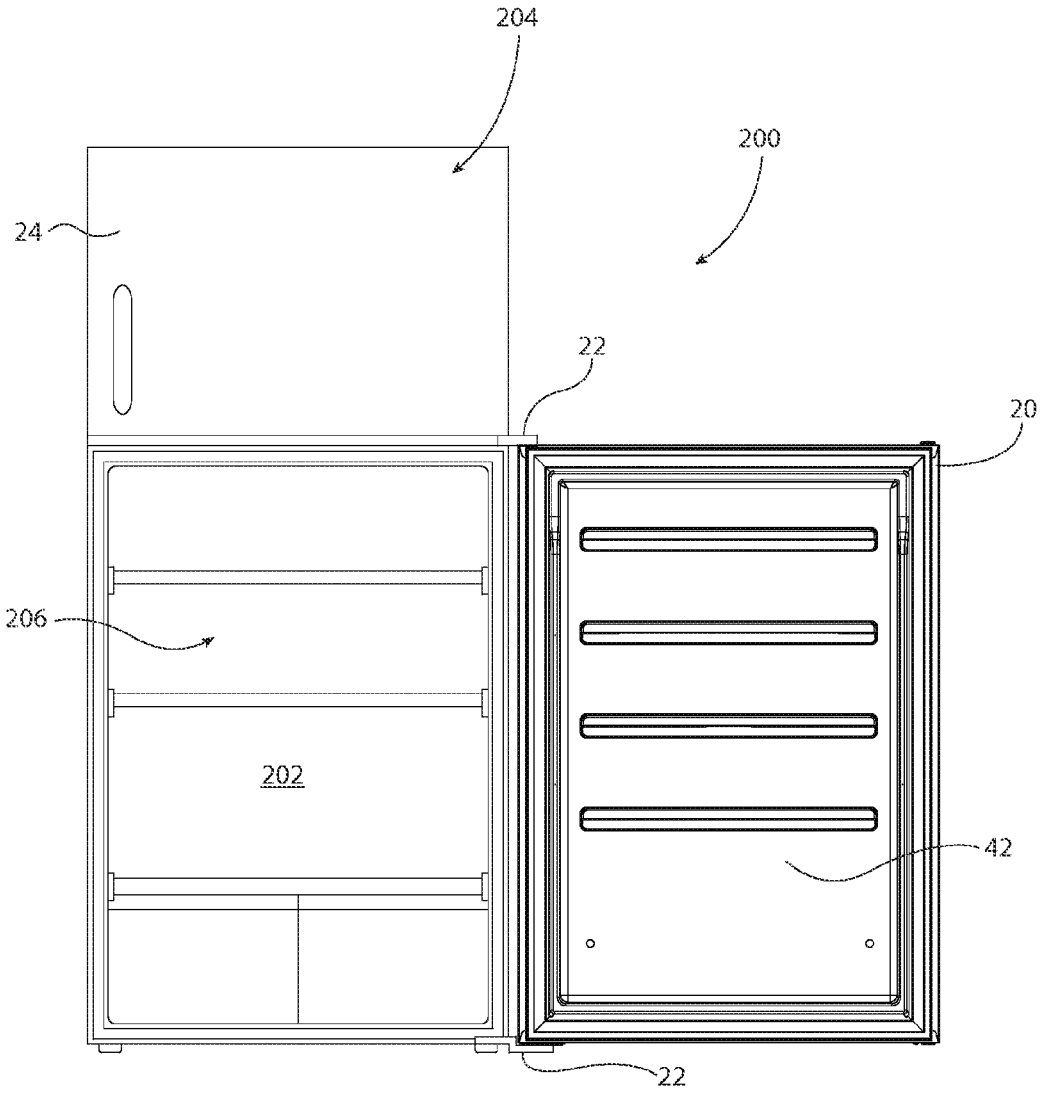
FIG. 1 is a schematic view of a refrigerator including an example door assembly.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Conventionally, refrigerator doors include a metal exterior skin, foam (for insulation and support), a plastic inner liner, and a door stop and bearing. The bearings and door stop prevent the door from tilting when weight is applied to the door (e.g., items loaded on the shelves), and are mounted in the exterior metal skin and gain support from the foam. However, today there is more support needed for the bearing and door/door stop interface as the doors are expected to carry more weight. The foam in the door provides much of the support for the bearing, and so there is a need to increase the contact between the bearing and the foam. The instant application provides a solution to connect a member to the bearing that extends the bearing into the foam, such as a reinforcement tube secured on the bearing or a fin design attached to the bearing. As a result, the instant application provides more structure to the door to restrict the bearing from moving in the foam, and also to restrict the bottom of the door from deflecting. The bearing supports can be installed at the top and bottom corners of the door.

Turning to the shown example of FIG. 1, a door 20 is described that can be used in different types of appliances, such as refrigeration appliances, freezers, dishwashers, ovens, or even other appliance types. For instance, the door 20 can be used in storage systems for refrigeration appliances such as refrigerator/freezer units, stand-alone refrigerators, standalone freezers, or the like. Although the example refrigerator is illustrated as a "top mount" refrigerator (i.e., freezer compartment located over the fresh food compartment), the instant door 20 could similarly be used in a side-by-side type refrigerator, bottom-mount refrigerator, French-door refrigerator, other types of refrigerators or freezers, or even other appliances such as stoves, microwaves, washers, dryers, dishwashers, etc. In addition to white goods (e.g., appliances), the door described herein can be used with furniture, storage applications, architectural applications, or wherever else an insulated, reinforced door might be used.

FIG. 1 depicts a schematic view of a refrigerator 200 including a schematic depiction of a door 20 in accordance with aspects of the present application. Typically, the refrigerator 200 provides a main cabinet which is divided into a fresh food compartment 202 and a freezer compartment 204. The lower door 20 is pivotally connected on hinges 22 and functions to open or close the fresh food compartment 202 to provide access to an interior area 206 as desired. Similarly, the upper door 24 is also mounted on hinges and functions to open or close the freezer compartment 204. The refrigerator door 20 could be configured to open towards the right or the left, and a similar design may be used for the upper freezer compartment door 24. It is further contemplated that the refrigerator door structure designed herein could be used in a drawer-style compartment, such as a freezer compartment door, multi-temperature compartment door, etc.

Figure 2:
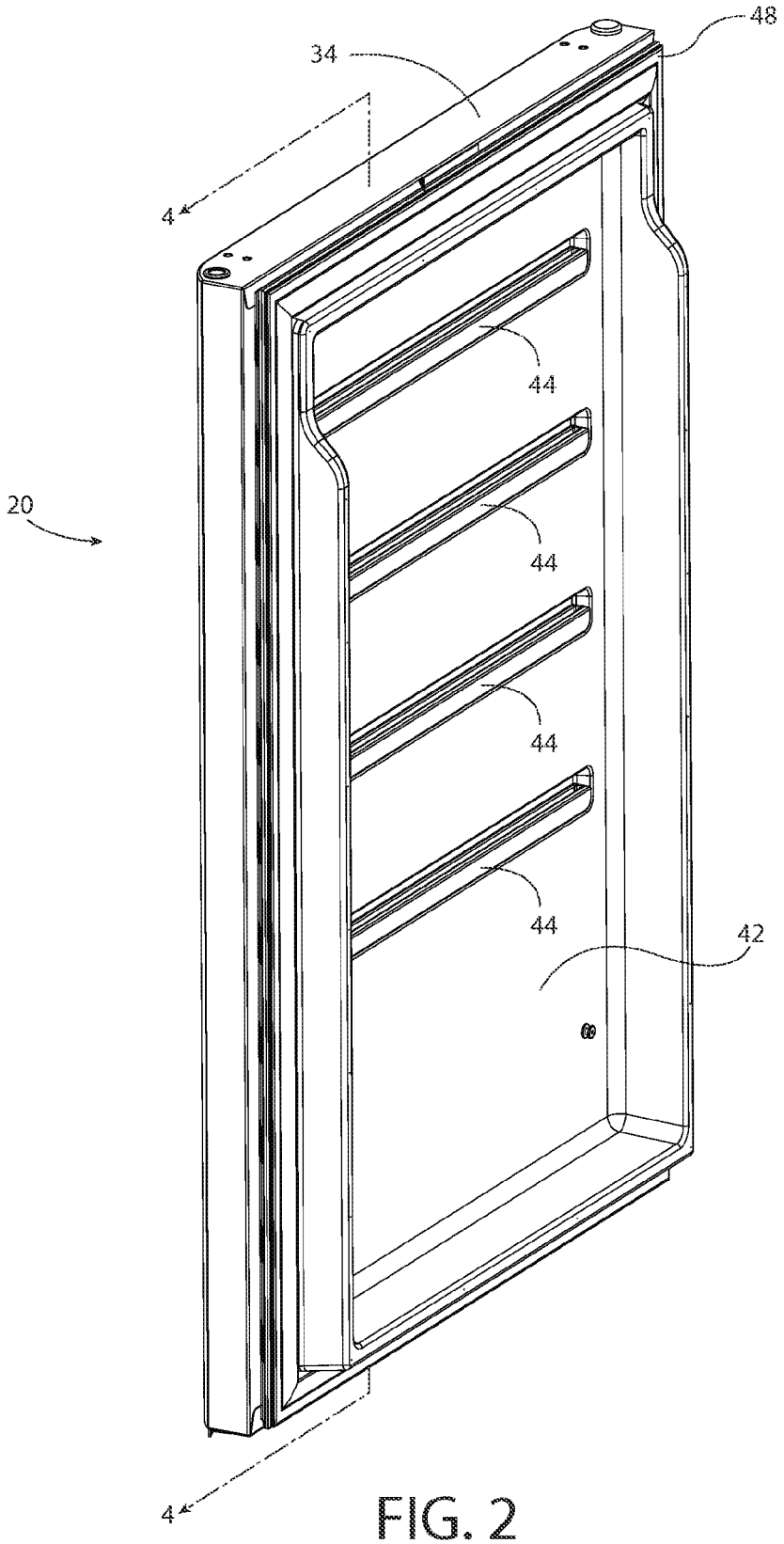
FIG. 2 is a perspective view of the example door assembly.
Figure 3:
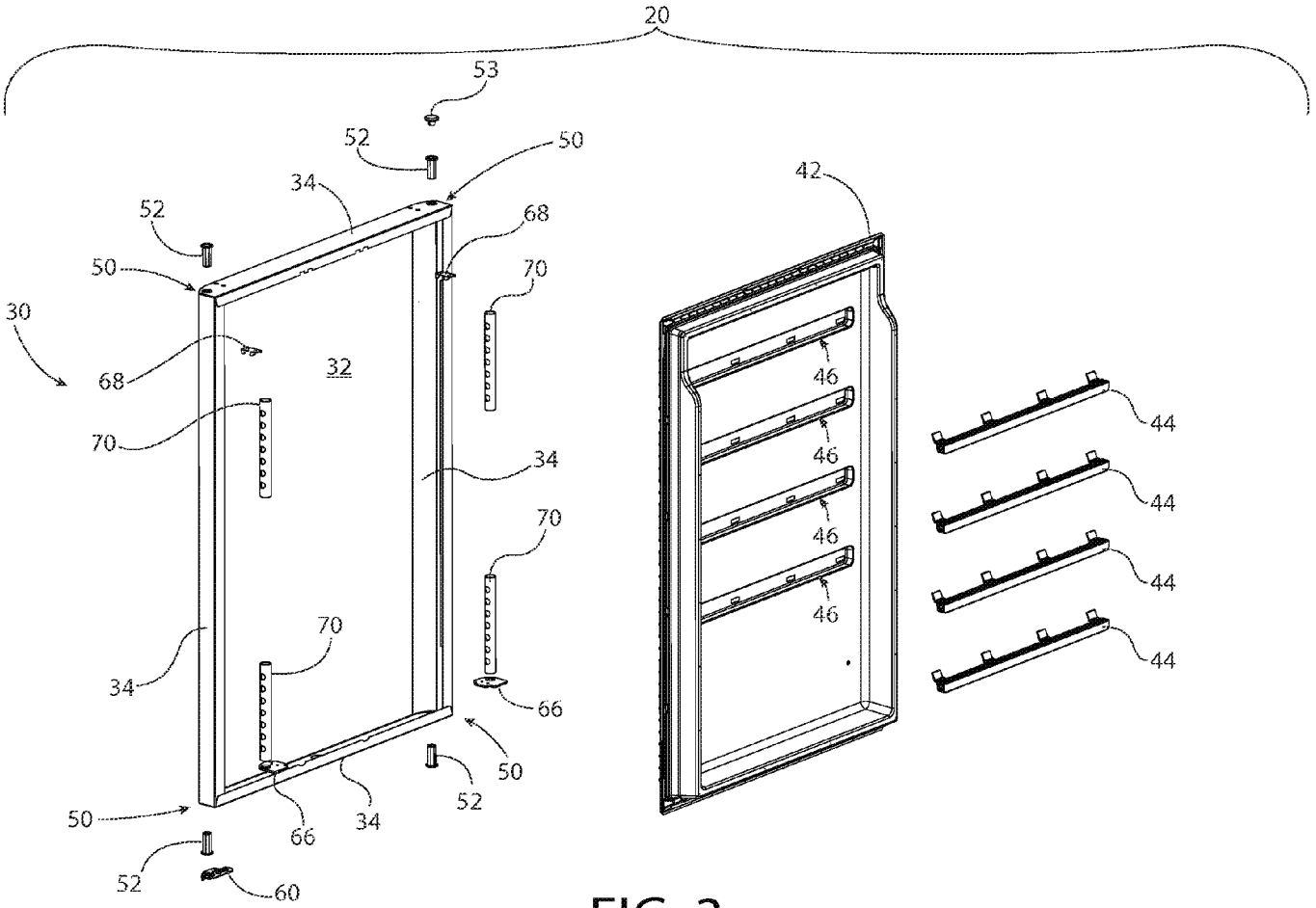
FIG. 3 is a perspective exploded view of the example door assembly.
Figure 4:
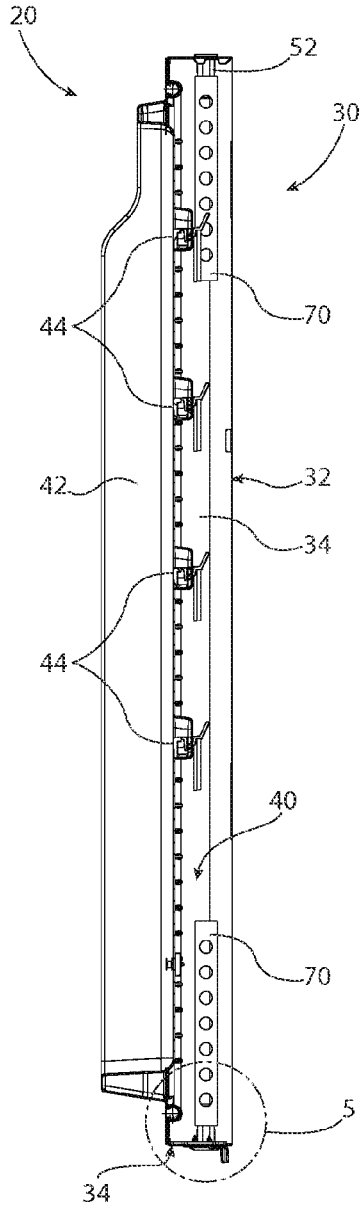
FIG. 4 is a side sectional view of the example door assembly.

Turning to FIG. 2, an example assembled refrigerator door 20 is illustrated apart from the refrigerator 200. The refrigerator door 20 includes a polygonal shell 30 having corners that defines at least part of a cavity 40 therein. The polygonal shell can have various shapes, such as rectangular or square (or other desired shape). As best illustrated in FIG. 3, the shell 30 includes an exterior panel 32 that provides a planar front face of the door 20, and an end panel 34 connected to the exterior panel 32. As shown, the shell 30 can include four end panels 34 that define the top, bottom, and both side edges of the door 20, respectively. The shell material can be bent rearward along each of the four sides to provide the four end panels 34 extending rearward from the exterior panel 32 to become inwardly extending flanges along the shell. Additional turned-in edges on the inwardly extending flanges may extend along a plane parallel to the plane of the exterior panel 32 but are spaced apart therefrom, which can provide a perimeter surface for attachment of the inner door liner. Still, it is contemplated that one or more of the end panels 34 could be removably or non-removably coupled to the exterior panel 32, such as by an end cap or the like. The shell 30 at least partly defines one side and the edges of the cavity 40 which is ultimately filled by foam insulation during the manufacture of the door 20.

The door 20 further includes an inner liner 42 that faces the interior area 206 of the refrigerator cabinet. The liner 42 is connected to the exterior panel 32 and spaced therefrom to define the cavity 40. Typically, the liner 42 is formed of molded plastic and provides shelves or compartments for storing items within the cooled space. Various shelves or other compartments may be molded into the liner 42 or removably/non-removably coupled to the liner 42, and/or may be provided otherwise. In the shown example, the liner 42 includes a plurality of horizontal rails 44 upon which various shelves, compartments, or other storage systems can be retained. Each of the rails 44 can be located within an associated recess 46 of the liner 42, and preferably has a projection or other portion that extends at least partially into an interior of the refrigerator door 20 so as to be supported by the foam insulation. The liner 42 can be coupled to the exterior panel 32 in various manners, including screws, adhesives, clips, various mechanical fasteners, etc. The liner 42 may even be partially or completely coupled to the exterior panel 32 via the cured insulation foam. A sealing gasket 48 surrounds an outer perimeter of the liner 42 so that the door 20 sealingly engages the cabinet of the refrigerator 200 to reduce the loss of cool air. The gasket 48 can be attached variously, and may snap-in to a recess 49 of the liner 42 (see FIG. 5).

Turning now to FIGS. 4-7B, a hinge bearing 52 is mounted to the polygonal shell 30 adjacent one corner 50 of the shell. The shell 30 has a plurality of corners, and at least one corner 50 is defined at an intersection of the exterior panel 32 and at least one end panel 34. The hinge bearings 52 in a given door can identical or different, however, for simplicity and clarity only one will be described and illustrated in detail. Preferably, the hinge bearing 52 is mounted to the end panel 34 that is adjacent said corner 50. Preferably, four hinge bearings 52 are mounted in the shell 30, with one at each corner, even though only two such hinge bearings are used in a given installation on the refrigerator cabinet. These four hinge bearings 52 are provided so that any given door can be mounted on the cabinet as either a lefthand opening or a righthand opening door. The hinge bearings 52 that are not used may have a removable plug 53 or the like inserted therein.

The hinge bearing 52 extends into the cavity 40 and defines a generally cylindrical passage 54 that is open at an outer end 56 exterior of the shell 30 to receive and journal a hinge pin (not shown) of the hinge 22 that is mounted to the refrigerator cabinet. The cylindrical passage 54 of the hinge bearing 52 is substantially closed at an inner end 58, although the inner end 58 may include one or more vent holes that can aid in gas release during a foaming operation. The hinge bearings 52 include an outer flange 55 which rests against the exterior surface of the shell 30. Extending through the associated opening in the shell is the cylindrical passage 54 which defines the opening extending from the outer open end 56 in the flange 55 to the inner end 58 with optional perforations. The exterior of the cylindrical passage 54 adjacent to the flange 55 can have various geometries, and may be circular or even non-circular. Similarly, the opening in the shell 30 may be correspondingly circular or non-circular, sized and shaped to mate with the adjacent portion of the hinge bearing 52 so that the hinge bearing 52 is held in position against rotation. Further, the cylindrical passage 54 may be provided with an outwardly extending shoulder which locks the hinge bearing 52 in place once it is snapped through the opening in the shell 30. Still, the hinge bearing 52 can be held in place using various other mechanisms, as described herein.

Figure 5:
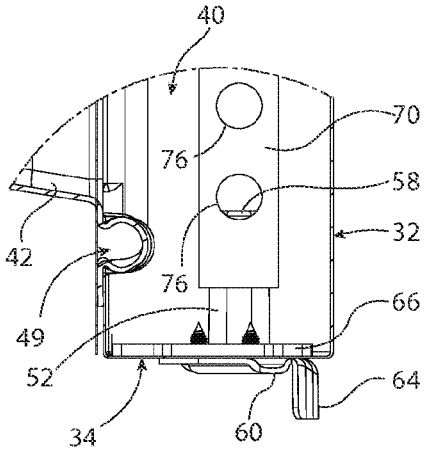
FIG. 5 is a detail view of an example hinge bearing and reinforcement tube.
Figure 6:
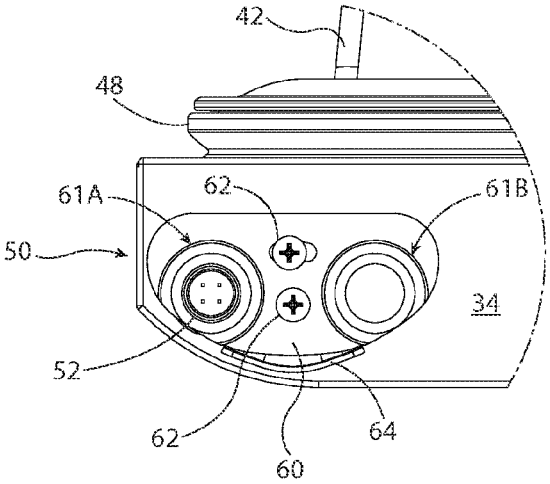
FIG. 6 is a bottom detail view of the example hinge bearing.

A door stop plate 60 is secured to the end panel 34 of the shell 30 and is located on an exterior of the shell 30 and adjacent the corner 50. The door stop plate 60 transfers the load from the door to the hinge 22, and helps to distribute this force over a larger area of the bottom exterior door. Further, as shown in FIG. 5, the door stop plate 60 can provide a positive stop 64, such as by an outward projection, to prevent the door from opening beyond a preselected position or rotational angle. The door stop plate 60 is coupled to the end panel by a mechanical fastener, such as screws 62 or other fasteners, or even adhesives, etc. The door stop plate 60 can secure the hinge bearing 52 to the end panel 34, so that the hinge bearing 52 is clamped between the door stop plate 60 and the end panel 34. In one example, the door stop plate 60 can include a concave recess on an upper surface thereof to receive the outer flange 55 at the end of the hinge bearing 52. Thus, in the assembled state, the outer flange 55 of the hinge bearing 52 is located between the door stop plate 60 and the end panel 34 of the door. The door stop plate 60 further includes at least one hole 61A or opening extending therethrough, located about the outer end of the hinge bearing 52 to provide access to the interior cylindrical passage 54 for the hinge pin. Preferably, the door stop plate 60 includes a second hole 61B (or even 3 or more holes) so that a single part can be used on different doors for different installation configurations. The unused hole 61B can be filled by an optional end cap or the like. Indeed, where two or more holes 61A, 61B are provided, at least one of the screw receiving holes of the door stop plate 60 can have a curved or oversized profile to further allow limited movement and proper alignment of the door stop plate 60 during installation. The holes 61A, 61B may be aligned with the associated concave recesses to help ensure alignment with the interior cylindrical passage 54 of the hinge bearing 52 to reduce friction with the hinge pin.

Additionally, a tapping plate 66 can be located within the cavity and secured to the end panel 34 and the door stop plate 60. The tapping plate 66 provides a strong, structural member of sufficient thickness to receive and securely retain mechanical fasteners, such as the screws 62 of the door stop plate 60 or other structure. In this manner, the door stop plate 60 is secured to the tapping plate 66 by the screws 62 or other fasteners. The tapping plate 66 can further provide an opening through which the hinge bearing 52 extends. The opening may be oversized, relative to the hinge bearing, to ease installation and manufacturing. The tapping plate 66 can have a relatively loose fit to the hinge bearing 52 and sides of the exterior door. The addition of the tapping plate 66 on the inside of the door in the same area increases the stiffness of the bottom of the door, which acts as rigid member that will not locally dent or move like the relatively thin metal exterior door might. In other words, the tapping plate 66 provides additional material thickness where the load from the door stop is transferred to the exterior door skin, increasing the force required to push the bottom door skin in. The tapping plate 66 can also increase the area of foam that must be displaced to allow the bottom of the door to move. The tapping plate 66 can be made of plastic or metal, can be flat or have some rib structure (honey comb pattern, etc.) added for increased stiffness, or can even be a full box like structure. The above described tapping plate 66 can be used for a bottom corner of the shell 30, where greater forces occur to support the door against gravity. However, a similar or different tapping plate 68 can be provided at the upper corners of the shell 30, such as shown in FIG. 3. It is possible to reduce the size and shape of these upper tapping plates 68 since they often experience less force and stress. Similarly, an upper door stop plate (not shown) may be used or may be omitted.

Figure 7A:
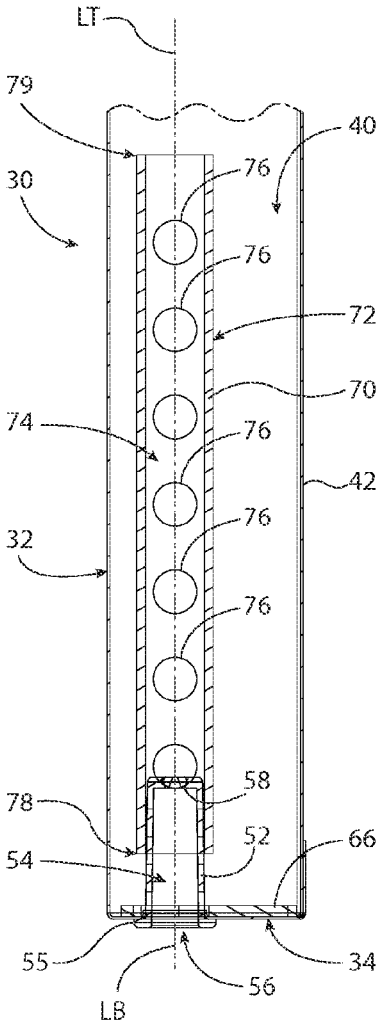
FIGS. 7A-7B are sectional, detail views of the example reinforcement tube, before and after foam insulation.
Figure 7B:
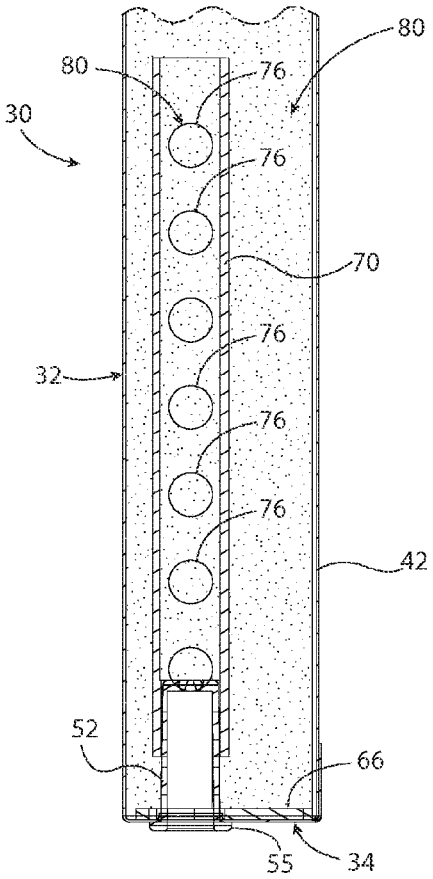

Turning now to FIGS. 7A-7B, a reinforcement tube 70 is secured to the hinge bearing 52 and extends a distance inwardly within the cavity 40 of the shell 30. At least one reinforcement tube 70 is used, and preferably each bottom corner includes a reinforcement tube. Even more preferably, as shown in FIG. 3, all four corners of the shell 30 each include a reinforcement tube. For clarity and simplicity, only one reinforcement tube will be described. The use of the reinforcement tube 70 provides more structure to the door that restricts the hinge bearing 52 from moving within the structural foam 80 of the shell 30. In other words, the reinforcement tube 70 can help to effectively extend the hinge bearing further into the foam 80, and can further provide increased surface contact with the foam 80. This increases the force required to move the hinge bearing and door bottom in the foam, because now any such outside forces from use and loading of the door have to displace relatively more foam to move the hinge bearing, which results in a more structurally secure and rigid door construction. The reinforcement tube 70 can be made of suitable structurally rigid materials, such as metal or plastic.

The reinforcement tube 70 includes a sidewall 72 that defines a hollow interior 74, and at least one hole 76 extending through the sidewall 72 to provide communication between the cavity 40 of the shell 30 and the hollow interior 74. Additionally, the reinforcement tube 70 extends between a first end 78 and a second end 79 generally along a longitudinal axis LT. Once installed, the longitudinal axis LT of the reinforcement tube 70 is preferably coaxial with a longitudinal axis LB of the hinge bearing 52. In this manner, the reinforcement tube 70 effectively provides an extension of the hinge bearing 52 in its operational position and conditions to provide increased strength. Still, although the shown example illustrates the reinforcement tube 70 with a generally constant tubular shape that is substantially straight, various other geometries and interior areas are contemplated, as well as other alignment schemes relative to the hinge bearing 52.

The reinforcement tube 70 can be secured to the hinge bearing 52 in various manners, such as via an interference fit between the first end 78 of the reinforcement tube 70 and the inner end 58 of the hinge bearing 52. For example, the first end 78 of the reinforcement tube 70 can receive the inner end 58 of the hinge bearing 52, and the reinforcement tube 70 can then be pressed in a direction towards the flange end (i.e., downward in FIG. 7A) to cause an interference fit between the exterior surface of the hinge bearing 52 and the interior surface of the reinforcement tube 70. Various techniques can be used to ease installation and/or maintain a tight fit, such as using a tapered or stepped geometry on the exterior surface of the hinge bearing 52 or the interior surface of the reinforcement tube 70. In other examples, projections, ridges, knurling, or the like could be used on the exterior surface of the hinge bearing 52 or the interior surface of the reinforcement tube 70 to increase friction and a tighter fit. In still other examples, the hinge bearing 52 could include a raised projection that could be received within a corresponding recess or hole of the reinforcement tube 70, or vice-versa. Other mechanical fasteners could also be used, such as screws or the like. In addition to, or as an alternative to an interference fit, adhesives or welding could be used between the exterior surface of the hinge bearing 52 or the interior surface of the reinforcement tube 70.

As described herein, the insulation foam 80 is foamed in place during manufacture of the door that substantially fills the cavity 40 of the shell 30, including the corner(s) with the hinge bearing 52 and reinforcement tube 70. In order to further increase surface area contact with the foam 80, the insulation foam 80 penetrates into the hollow interior 74 of the reinforcement tube 70 via the at least one hole 76 through the sidewall 72. In this manner, the reinforcement tube 70 is at least partially filled with the foam 80, and preferably is substantially completely filled with the foam 80. In order to facilitate the foam penetration, a plurality of holes 76 can extend through the sidewall 72 of the reinforcement tube 70 so that the insulation foam penetrates into the hollow interior 74 via two or more of the holes 76. The plurality of holes 76 can be located variously about the sidewall 72 and along its length. Although shown as circular holes of similar size, any or all of the plurality of holes 76 can have the same or different shapes and sizes. In one example, as shown, the plurality of holes 76 are arranged along the longitudinal length of the reinforcement tube 70 and are generally in line with the longitudinal axis LT. In addition, the reinforcement tube 70 can further include an end hole defined in the second end 79 that provides further communication between the cavity 40 of the shell 30 and the hollow interior 74 of the reinforcement tube 70. The end hole can be an opening in the second end 79, or could even be a completely open end of a cylinder. The end hole is different from the hole(s) 76 extending through the sidewall 72 of the reinforcement tube 70. In this manner, greater access is provided for the foam 80 to penetrate into and throughout the hollow interior 74 of the reinforcement tube 70 for increased surface area contact with the foam 80.

During manufacture of the door 20, the hinge bearing 52 is inserted into the end panel 34, and then the door stop plate 60 is placed in a covering relationship. The tapping plate 66 is secured using the same screws as the door stop plate 60, and so it is installed after the hinge bearing 52 but before the reinforcement tube discussed herein. The reinforcement tube 70 is then secured to the hinge bearing 52 in the various manners described herein. Finally, an insulating foam 80 is injected into the cavity 40, which ultimately cures into an insulating and structural foam. While in a flowable state (i.e., non-rigid), the foam 80 substantially completely fills the cavity 40, and further penetrates into the hollow interior 74 of the reinforcement tube 70 via the holes 76 and the open second end 79, as shown in FIG. 7B. Preferably, each reinforcement tube 70 is substantially completely filled with foam 80. Once the foam cures into a rigid structural foam, the various hinge bearings 52 then have substantially increased strength and structural rigidity. Various foam materials may be used; however, typically, the foamable material is polyurethane or the like. Because the door is properly vented to allow gasses to escape, the finished insulation material foamed-in-place substantially completely fills the cavity 40 and provides a uniform insulation barrier preventing the flow of heat and preventing the existence of localized zones of insufficient insulation, which could cause spots of condensate collection and reduced efficiency.

Several advantages are realized by the instant design. Bearing support is increased by extending the bearing into the foam. The door stop plate acts as rigid member that will not locally dent or move as the thin metal exterior door will. Together, both of the bearing support and rigid plate provide more surface contact with the foam that increases the force required to move the bearing/door bottom in the foam. Overall, this reduces the door drop when weight is added to the shelves and bins of the door, in normal usage. Additionally, door drop is reduced over time when the door is cycled with weight in the door. The instant design also provides more structure to the door that restricts the hinge bearing from moving in the foam, and further provides more structure to the exterior door to restrict the bottom of the door from deflecting.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A door for a refrigerator appliance that is pivotally connected by a hinge, the door comprising:

a polygonal shell having corners and defining at least part of a cavity therein, wherein a distance between an opposed pair of said corners define a height of said door;

a hinge bearing mounted to the polygonal shell adjacent one of said corners, the hinge bearing extending into the cavity and defining a generally cylindrical passage to receive and journal a hinge pin of said refrigerator appliance;

a reinforcement tube comprising a first end secured to the hinge bearing and a second end extending a distance within the cavity that is less than half of the height of said door so that the second end is upstanding and spaced away from the hinge bearing, the reinforcement tube comprising a sidewall that defines a hollow interior and at least one hole extending through the sidewall to provide communication between the cavity and the hollow interior; and insulation foamed in place that substantially fills said cavity including said corner, wherein the insulation penetrates into the hollow interior of the reinforcement tube via said at least one hole.

2. The door of claim 1, wherein the hinge bearing defines a first longitudinal axis and the reinforcement tube defines a second longitudinal axis that is coaxial with the first longitudinal axis.

3. The door of claim 1, further comprising a plurality of holes extending through the sidewall of the reinforcement tube, wherein the insulation penetrates into the hollow interior of the reinforcement tube via two or more of the holes.

4. The door of claim 3, wherein the plurality of holes are arranged along a longitudinal length of the reinforcement tube.

5. The door of claim 1, wherein the reinforcement tube is secured to the hinge bearing by an interference fit.

6. The door of claim 1, wherein the polygonal shell includes an exterior panel and an end panel, and wherein an inner liner is connected to the exterior panel and spaced therefrom to define the cavity.

7. The door of claim 6, further comprising a door stop plate secured to the end panel and located on an exterior of the shell, the door stop plate located adjacent said corner.

8. The door of claim 7, further comprising a tapping plate located within the cavity and secured to the end panel and the door stop plate, and comprising an opening through which the hinge bearing extends.

9. The door of claim 1, wherein the second end defines an end hole providing further communication between the cavity and the hollow interior, the end hole being different from the at least one hole extending through the sidewall.

10. A door for a refrigerator appliance that is pivotally connected by a hinge, the door comprising:

an exterior panel;

an end panel connected to the exterior panel, and a corner being defined at an intersection of the exterior panel and end panel;

an inner liner connected to the exterior panel and spaced therefrom to define a cavity;

a hinge bearing mounted to the end panel adjacent said corner and defining a generally cylindrical passage to receive and journal a hinge pin of said refrigerator appliance, wherein the cylindrical passage is open at an outer end exterior of the end panel and substantially closed at an inner end;

a reinforcement tube comprising a first end secured to the inner end of the hinge bearing and a second end extending a distance within the cavity such that the second end is spaced away from the hinge bearing, the reinforcement tube comprising a sidewall defined between the first and second ends that defines a hollow interior and at least one hole extending through the sidewall to provide communication between the cavity and the hollow interior, and the second end defining an end hole providing further communication between the cavity and the hollow interior; and insulation foamed in place filling said cavity including said corner, wherein the insulation penetrates into the hollow interior of the reinforcement tube via said at least one hole and via the end hole of the second end.

11. The door of claim 10, wherein the hinge bearing defines a first longitudinal axis and the reinforcement tube defines a second longitudinal axis that is coaxial with the first longitudinal axis.

12. The door of claim 10, further comprising a plurality of holes extending through the sidewall of the reinforcement tube, wherein the insulation penetrates into the hollow interior of the reinforcement tube via two or more of the holes.

13. The door of claim 12, wherein the plurality of holes are arranged along a longitudinal length of the reinforcement tube.

14. The door of claim 10, wherein the reinforcement tube is secured to the hinge bearing by an interference fit.

15. The door of claim 10, further comprising a door stop plate secured to the end panel and located on an exterior of the end panel, the door stop plate located adjacent said corner and comprising an opening located about the outer end of the hinge bearing.

16. The door of claim 15, wherein the outer end of the hinge bearing comprises a flange that is located, in an assembled state, between the door stop plate and the end panel of the door.

17. The door of claim 15, further comprising a tapping plate located within the cavity and secured to the end panel and the door stop plate, and comprising an opening through which the hinge bearing extends.

18. The door of claim 17, wherein the door stop plate is coupled to the end panel by a mechanical fastener that is secured into the tapping plate, so that the hinge bearing is clamped between the door stop plate and the end panel.

* * * * *